US009758328B2

(12) United States Patent
Lin et al.

(10) Patent No.: US 9,758,328 B2
(45) Date of Patent: Sep. 12, 2017

(54) TRANSPORT MECHANISM FOR PERIPHERAL DEVICE AND OPERATING METHOD THEREOF

(71) Applicant: AVISION INC., Hsinchu (TW)

(72) Inventors: Chen-Pang Lin, Hsinchu County (TW); Sheng-Yao Shih, Miaoli County (TW); Chin-Chu Chiu, Hsinchu County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/141,718

(22) Filed: Apr. 28, 2016

(65) Prior Publication Data

US 2016/0318725 A1 Nov. 3, 2016

(30) Foreign Application Priority Data

May 1, 2015 (TW) ..... 104114050 A

(51) Int. Cl.
*B65H 7/02* (2006.01)
*B65H 7/18* (2006.01)
(Continued)

(52) U.S. Cl.
CPC ..... *B65H 7/18* (2013.01); *B65H 5/062* (2013.01); *B65H 5/38* (2013.01); *B65H 7/06* (2013.01);
(Continued)

(58) Field of Classification Search
CPC ... B65H 1/02; B65H 1/04; B65H 1/06; B65H 3/063; B65H 5/062; B65H 5/066;
(Continued)

(56) References Cited

U.S. PATENT DOCUMENTS 4,591,145 A 5/1986 Cherian
5,615,876 A * 4/1997 Yergenson ..... B65H 7/06 271/258.01
(Continued)

FOREIGN PATENT DOCUMENTS

TW 309141 U 6/1997
TW M449705 U1 4/2013

OTHER PUBLICATIONS

TW Office Action dated Jul. 5, 2016 as received in Application No. 10411050 (Partial Translation).
(Continued)

*Primary Examiner* — Prasad Gokhale

(57) ABSTRACT

A transport mechanism for a peripheral device and an operating method including the same are provided. The transport mechanism includes a tray, at least a transport roller, a detector, a trigger component and a processor. The tray includes an opening extending through the tray. The transport roller is rotatably installed in the opening and protruded from the tray to transport a flexible object to move along a transport path. The detector near the tray has a detecting area. The trigger component is located in the opening and spaced apart from the flexible object on the transport path. The flexible object deviated from the transport path presses the trigger component to enter or leave the detecting area and triggers the detector to transmit an abnormal detecting signal. The processor receives the abnormal detecting signal to stop the transport roller.

7 Claims, 11 Drawing Sheets

(51) Int. Cl.

| | |
|---|---|
| ***B65H 7/08*** | (2006.01) |
| ***B65H 5/06*** | (2006.01) |
| ***B65H 7/06*** | (2006.01) |
| ***B65H 7/20*** | (2006.01) |
| ***B65H 5/38*** | (2006.01) |

(52) U.S. Cl.
CPC ..... *B65H 7/08* (2013.01); *B65H 7/20* (2013.01); *B65H 2404/5331* (2013.01); *B65H 2511/51* (2013.01); *B65H 2511/528* (2013.01); *B65H 2513/512* (2013.01); *B65H 2553/412* (2013.01); *B65H 2553/612* (2013.01)

(58) Field of Classification Search
CPC . B65H 5/068; B65H 7/02; B65H 7/06; B65H 7/08; B65H 7/14; B65H 7/18; B65H 7/20; B65H 2511/52; B65H 2511/522; B65H 2511/528; B65H 2511/51; B65H 2553/60; B65H 2553/61; B65H 2553/612; B65H 2553/412; B65H 2601/20; B65H 2601/25; B65H 2601/2525; B65H 2601/255; B65H 2513/512
See application file for complete search history.

(56) References Cited

U.S. PATENT DOCUMENTS

| | | | | |
|---|---|---|---|---|
| 6,334,723 | B1 * | 1/2002 | Trovinger | B41J 11/005 271/258.05 |
| 8,136,811 | B1 * | 3/2012 | Kuo | B65H 3/0684 271/227 |
| 2008/0174063 | A1 * | 7/2008 | Bridges | B65H 1/04 271/25 |
| 2009/0166953 | A1 * | 7/2009 | Osakabe | B65H 7/02 271/18 |
| 2010/0301550 | A1 * | 12/2010 | Muratani | B65H 7/06 271/264 |
| 2014/0197268 | A1 * | 7/2014 | Zhang | G07B 5/00 242/563 |
| 2015/0329303 | A1 * | 11/2015 | Xie | B65H 3/06 271/273 |

OTHER PUBLICATIONS

Taiwan Office Action dated Apr. 13, 2017 as received in Application No. 104114050.

* cited by examiner

100

100

100

200

TRANSPORT MECHANISM FOR PERIPHERAL DEVICE AND OPERATING METHOD THEREOF

CROSS-REFERENCE TO RELATED APPLICATIONS

This non-provisional application claims priority under 35 U.S.C. §119(a) on Patent Application No(s). 104114050 filed in Taiwan, R.O.C. on May 1, 2015, the entire contents of which are hereby incorporated by reference.

TECHNICAL FIELD

The disclosure relates to a transport mechanism for a peripheral device and an operating method including the same, more particularly to a transport mechanism for a peripheral device and an operating method including the same for detecting transport situation of flexible objects.

BACKGROUND

In the past, documents are only preserved as paper files. With the development of digital technology, documents can also be digitalized and preserved as digital files. Therefore, the storage space for preserving the documents is reduced as the digital files occupy less storage space than the physical files.

The information on the paper files is able to be digitalized by a scanner. An automatic paper feeding mechanism of the scanner favorably increases the efficiency of scanning the paper files.

SUMMARY

According to one embodiment of the disclosure, a transport mechanism for a peripheral device includes a tray, at least one transport roller, a detector, a trigger component and a processor. The tray includes a supporting surface, a back surface and at least one opening. The supporting surface and the back surface are opposite to each other. The at least one opening extends through the supporting surface and the back surface. The supporting surface is for supporting a flexible object. The at least one transport roller is rotatably installed in the at least one opening and protruded from the supporting surface. The at least one transport roller is for transporting the flexible object to move along a transport path. The detector near the back surface of the tray has a detecting area. The trigger component includes at least one pressed portion and a moving portion which are connected with each other. A portion of the at least one pressed portion is movably located in the at least one opening and spaced apart from the flexible object on the transport path. The moving portion is corresponding to a sensing area of the detector. When the flexible object is deviated from the transport path, the at least one pressed portion is pressed by the flexible objects so as to drive the moving portion to enter or leave the detecting area and thereby triggers the detector to transmit an abnormal detecting signal. The processor is electrically connected to the detector and the at least one transport roller. The processor is configured to stop the transport roller when receiving the abnormal detecting signal.

According to one embodiment of the disclosure, an operating method of a transport mechanism for a peripheral device includes the following steps. Rotate a transport roller to transport a flexible object. Transmit a detecting signal by a detector according to a relative position between a trigger component and the detector. When the trigger component is pressed by the flexible object, the detecting signal transmitted by the detector is abnormal. When the trigger component is not pressed by the flexible object, the detecting signal transmitted by the detector is normal. Receive the detecting signal by a processor and determines the detecting signal is abnormal or normal. When the detecting signal is abnormal, the processor controls the transport roller to stop rotating. When the detecting signal is normal, the processor controls the transport roller to keep rotating.

BRIEF DESCRIPTION OF THE DRAWINGS

The present invention will become better understood from the detailed description given hereinbelow and the accompanying drawings which are given by way of illustration only and thus are not limitative of the present invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
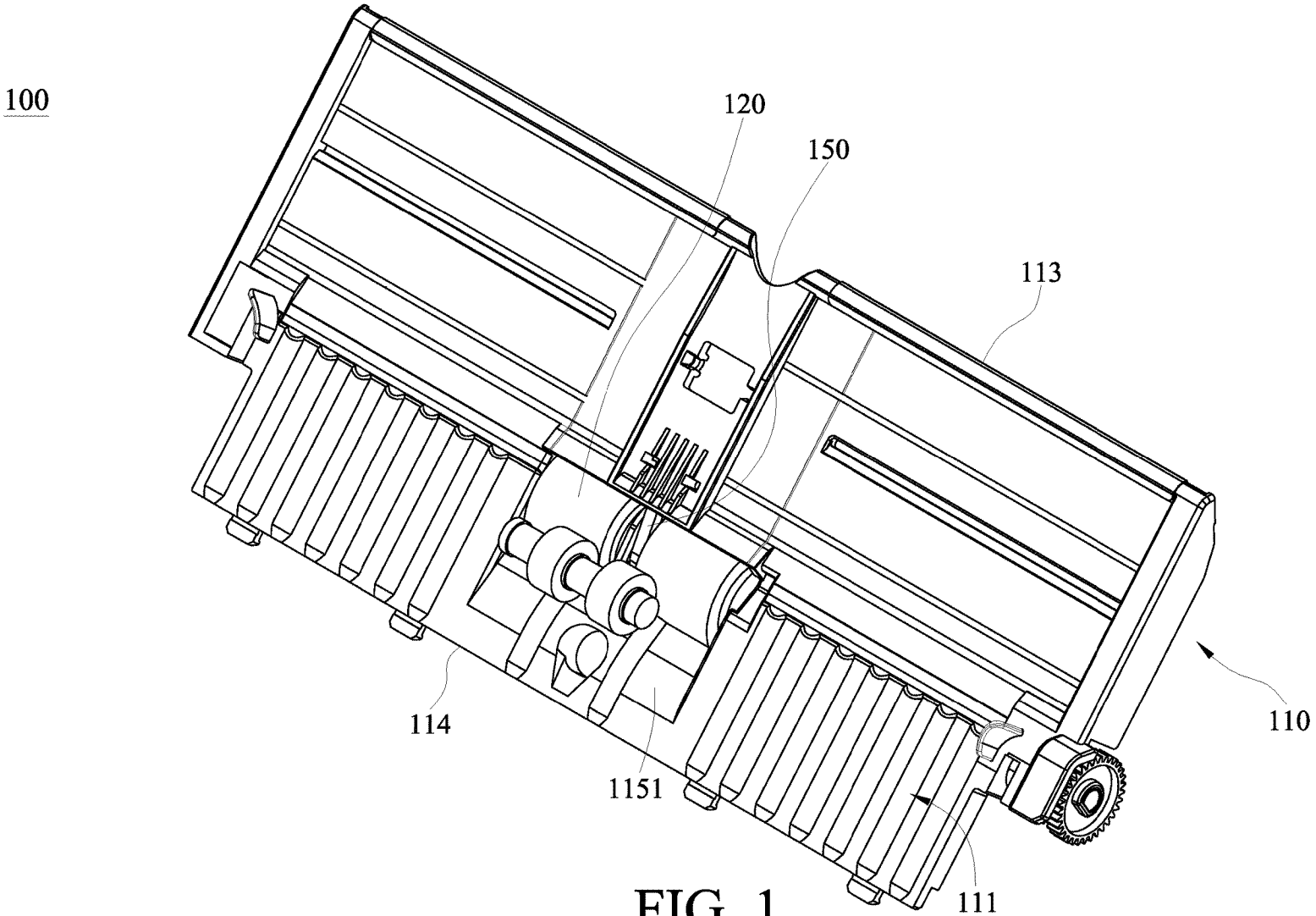
FIG. 1 is a perspective view of a transport mechanism from one viewing angle according to a first embodiment of the disclosure.
Figure 2:
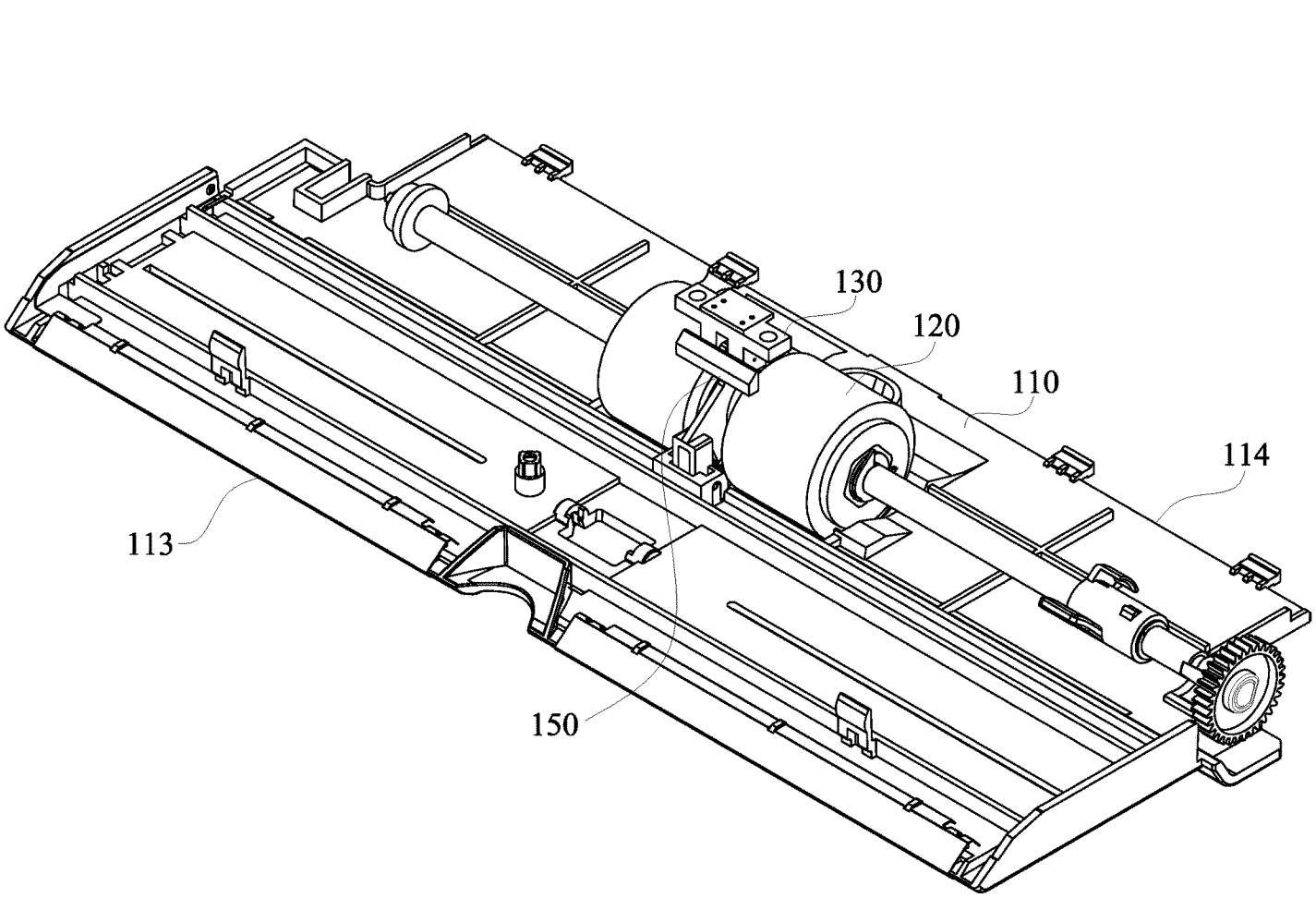
FIG. 2 is a perspective view of the transport mechanism from another viewing angle according to the first embodiment of the disclosure.
Figure 3:
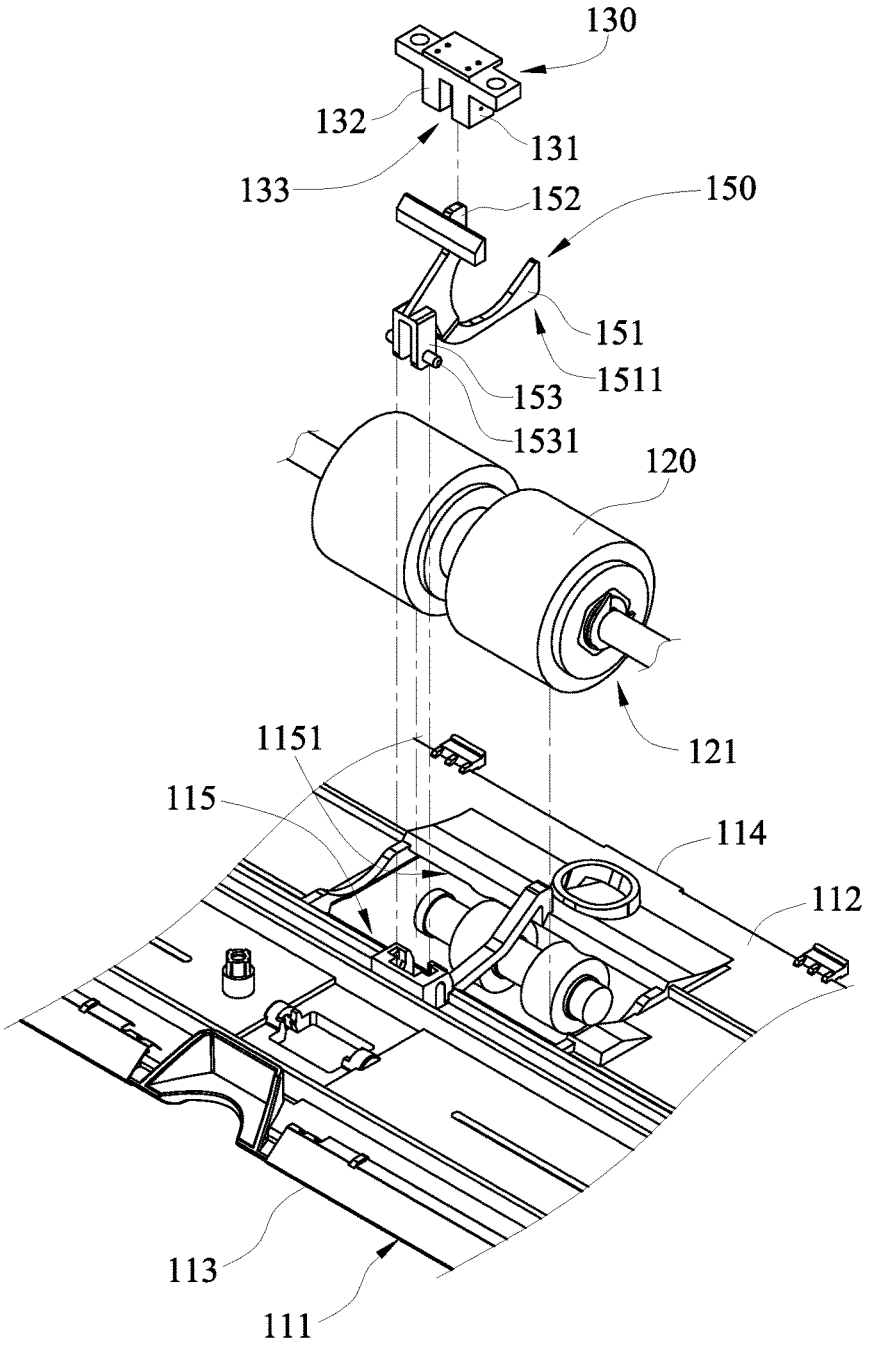
FIG. 3 is an exploded view of the transport mechanism according to the first embodiment of the disclosure.
Figure 4:
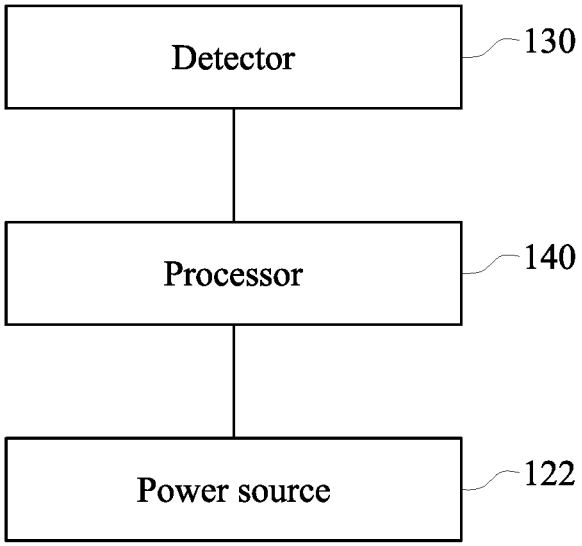
FIG. 4 is a block diagram of an electrical-signal connecting relationship in the transport mechanism according to the first embodiment of the disclosure.
Figure 5:
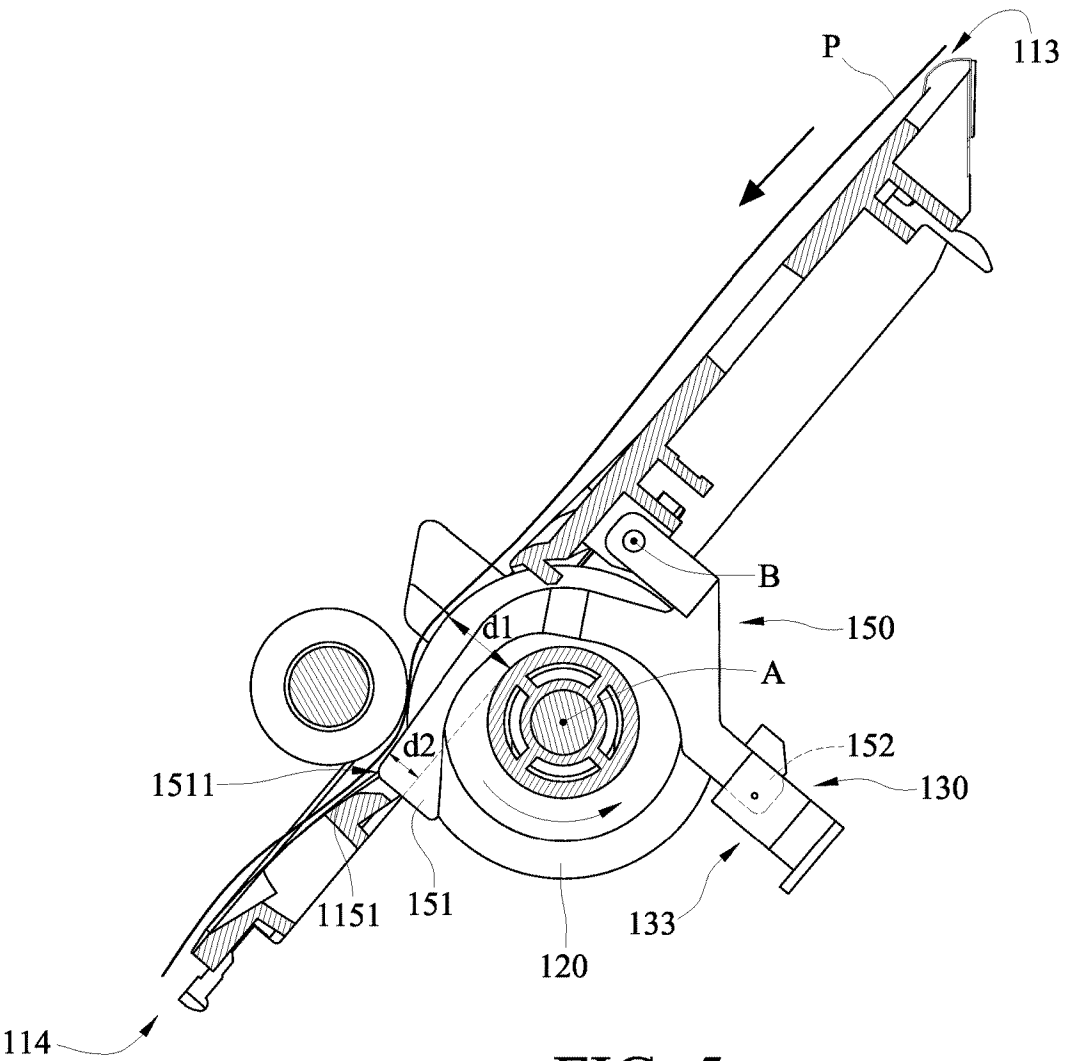
FIG. 5 is a cross-sectional view of the transport mechanism transporting a flexible object at a normal transport status according to the first embodiment of the disclosure.

Please refer to FIG. 1 to FIG. 5. FIG. 1 is a schematic view of a transport mechanism from one viewing angle according to a first embodiment of the disclosure. FIG. 2 is a schematic view of the transport mechanism from another viewing angle according to the first embodiment of the disclosure. FIG. 3 is an exploded view of the transport mechanism according to the first embodiment of the disclosure. FIG. 4 is a block diagram of an electrical-signal connecting relationship in the transport mechanism according to the first embodiment of the disclosure. FIG. 5 is a cross-sectional view of the transport mechanism transporting a flexible object at a normal transport status according to the first embodiment of the disclosure. In this embodiment, a transport mechanism 100 includes a tray 110, two transport rollers 120, a detector 130, a processor 140 and a trigger component 150.

The tray 110 has a supporting surface 111, a back surface 112, an input side 113, an output side 114 and two openings 115. The supporting surface 111 and the back surface 112 are opposite to each other. The input side 113 and the output side 114 are opposite to each other and located between the supporting surface 111 and the back surface 112. Each of the two openings 115 extends through the supporting surface 111 and the back surface 112. Each of the two openings 115 has an inclined surface 1151. The inclined surface 1151 is a side surface of the opening 115 which is close to the output side 114. The inclined surface 1151 connects the supporting surface 111 and the back surface 112, and the inclined surface 1151 faces away from the back surface 112. The function of the inclined surface 1151 will be introduced later. The transport mechanism 100, for example, is located in a peripheral device for transporting a flexible object P. The peripheral device, for example, is a copy machine, a scanner, a printer or a multifunctional machine with copy, scan and print function. The flexible object P can be bent during transportation by the transport mechanism. The flexible object P, for example, is a sheet, a film or a paper.

The two transport rollers 120 are rotatably located in the two openings 115, respectively. Each of the two transport rollers 120 is able to rotate along a first rotating axis A relative to the tray 110. The transport roller 120 is spaced apart from the side surface of the opening 115 which the transport roller 120 located in. Each of the two transport rollers 120 has a top edge 121 protruded from the supporting surface 111, and the top edge 121 is also protruded from the back surface 112 towards the transport path by a first distance d1. The two transport rollers 120 are for driving the flexible object P to move along the transport path on the supporting surface 111 from the input side 113 to the output side 114. In this embodiment, a power source 122, such as a motor, is provided to drive the two transport rollers 120 to rotate relative to the tray 110.

When an edge of the flexible object P leaves the two transport rollers 120, the inclined surface 1151 of the opening 115 guides the edge of the flexible object P to move toward the output side 114 and prevents the edge of the flexible object P from moving into a gap between the side surface of the opening 115 and the transport roller 120. The transport mechanism 100 may generates static electricity on the flexible object P during the transportation, and the static electricity on the flexible object P may disturb the edge of the flexible object to leave the transport roller 120 and move toward the output side 114 of the tray 110. As a result, in other embodiments of the present disclosure, the inclined surface is covered by a destaticizer (not shown). The destaticizer is made of conductive materials, such as metal or graphite, for removing the static electricity on an object which contacts the destaticizer. When the flexible object P with the static electricity contacts the destaticizer, the static electricity on the flexible object P is removed by the destaticizer so that the edge of the flexible object P without the static electricity is able to leave the transport roller 120 fluently and be guide by the inclined surface 1151 to move toward the output side 114. Therefore, with the guiding of the inclined surface 1151, the edge of the flexible object P leaving the transport rollers 120 is able to move toward the output side 114 fluently, and the inclined surface 1151 also prevents the edge of the flexible object P from moving into the gap between the side surface of the opening 115 and the transport roller 120.

The detector 130 is located near the back surface 112 of the tray 110. Specifically, the detector 130 is located under the tray 110. The detector 130 includes a signal-transmit portion 131, a signal-receive portion 132 and a detecting area 133. The detecting area 133 is located between the signal-transmit portion 131 and the signal-receive portion 132. In detail, in this embodiment, the signal-transmit portion 131 is for transmitting a signal to the signal-receive portion 132, and the signal-receive portion 132 is for receiving the signal from the signal-transmit portion 131. The detecting area 133 is defined as a region where the signal transmitted by the signal-transmit portion 131 and received by the signal-receive portion 132 passes through.

The processor 140, for example, is a central processing unit (CPU) or an application-specific integrated circuit (ASIC). The processor 140 is electrical connected to the detector 130 and the power source 122 of the two transport rollers 120. The processor 140 controls the power source 122 to rotate the two transport rollers 120 for transporting the flexible object. In addition, the processor 140 also electrically connected to a display unit (not shown) for displaying the transportation status of the transportation mechanism.

The trigger component 150 includes a pressed portion 151, a moving portion 152 and a pivotal portion 153. The pivotal portion 153 is connected to the pressed portion 151 and the moving portion 152. The pivotal portion 153 is pivoted under the tray 110 so that the trigger component 150 is rotatable along a second rotating axis B relative to the tray 110. The pressed portion 151 is located in one of the two openings 115, and the pressed portion 151 is also located between the two transport rollers 120. The moving portion 152 is corresponded to the detecting area 133 of the detector 130. When the pressed portion 151 is pressed by the flexible object P, the trigger component 150 is rotated relative to the tray 110 so as to drive the moving portion 152 to leave the detecting area 133 for triggering the detector 130. Wherein, the second rotating axis B is located between the first rotating axis A of the transport roller 120 and the supporting surface 111 of the tray 110 to improve the sensitivity of the trigger component 150. Specifically, an extending direction of the trigger component 150 is substantially parallel to the tray 110 so that the flexible object P almost perpendicularly presses the pressed portion 151 to rotate the trigger component 150. Thus, the trigger component 150 favorably triggers the detector 130 timely when the flexible object P deviated from the transport path enters the opening 115.

In the first embodiment of the present disclosure, the pressed portion 151 is located between the two transport rollers 120, but the disclosure is not limited thereto. In other embodiments of the present disclosure, the pressed portion can be located at a side of one of the two transport rollers which is away from the other transport roller. Furthermore, the top edge 1511 of the pressed portion 151 is located above the inclined surface 1151, and there is a second distance d2 between the top edge 1511 of the pressed portion 151 and the back surface 112 of the tray 110. The second distance d2 can be smaller than the first distance d1 for preventing the flexible object P pressing the top edge 1511 of the pressed portion 151 when the flexible object P is moved along the transport path. In the first embodiment of the present disclosure, the moving portion 152 is normally located in the detecting area 133. However, the disclosure is not limited to the location of the moving portion. In other embodiments of the present disclosure, the moving portion can be normally located out of the detecting area. When the pressed portion is pressed by the flexible object P, the trigger component drives the moving portion to enter the detecting area for triggering the detector.

In the first embodiment of the present disclosure, the trigger component 150 is pivoted at the tray 110 by the pivotal portion 153, but the disclosure is not limited to the way of installing the trigger component at the tray. In other embodiments of the present disclosure, the trigger component can be slidably installed at the tray so that the trigger component can slide relative to the tray to drive the moving portion to enter or leave the detecting area for triggering the detector when the pressed portion is pressed by the flexible object.

In the first embodiment of the present disclosure, both of the number of the opening 115 and the transport roller 120 are two. However, the disclosure is not limited to the number of the opening and the number of the transport roller. In other embodiments of the present disclosure, the number of the opening can be one or more than two, and the number of the transport roller can be one or more than two.

The following describes a normal transport status when transporting the flexible object P by the transport mechanism 100. As shown in FIG. 5, when the flexible object P is transported in the normal transport status, the flexible object P is driven by the transport roller 120 to move from the input side 113 to the output side 114 above the supporting surface 111. Before the flexible object P arriving the output side 114, the flexible object P passing the transport roller 120 keeps a distance from the top edge 1511 of the pressed portion 151. The moving portion 152 of the trigger component 150 is normally located in the detecting area 133 so as to block the signal transmitted between the signal-transmit portion 131 and the signal-receive portion 132, and thereby the detector 130 sends a normal detecting signal to the processor 140.

Figure 6:
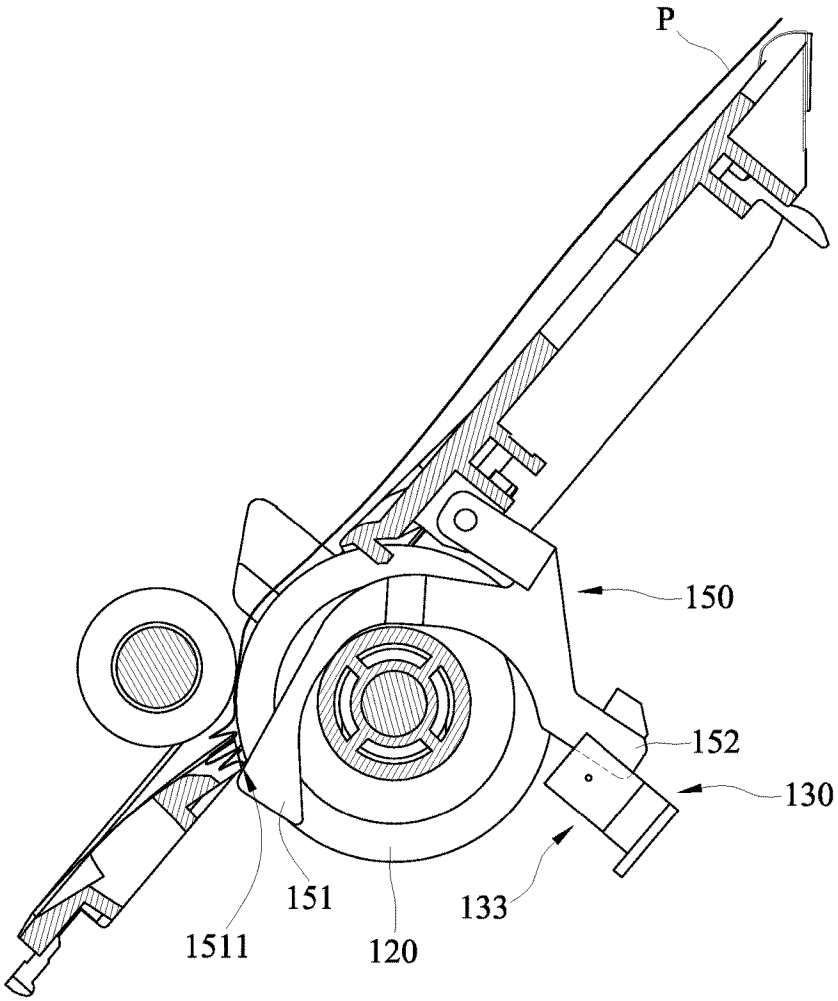
FIG. 6 is a cross-sectional view of the transport mechanism transporting the flexible object at an abnormal transport status according to the first embodiment of the disclosure.

The following describes an abnormal transport status when transporting the flexible object P by the transport mechanism 100; please refer to FIG. 6. FIG. 6 is a cross-sectional view of the transport mechanism transporting the flexible object at an abnormal transport status according to the first embodiment of the disclosure When the flexible object P is warped, folded or spilt, the flexible object P is moved into the opening 115 by the transport roller 120 easily so as to cause the abnormal transport status. When the flexible object P is moving into the opening 115, the flexible object P presses the pressed portion 151 of the trigger component 150 so as to drive the moving portion 152 to rotate relative to the tray 110. Therefore, the moving portion 152 is moved away from the detecting area 133 of the detector 130. As a result, the signal-receive portion 132 of the detector 130 receives the signal from the signal-transmit portion 131, and then the detector 130 sends an abnormal detecting signal to the processor 140. The abnormal detecting signal, for example, is a paper jam signal.

Figure 7:
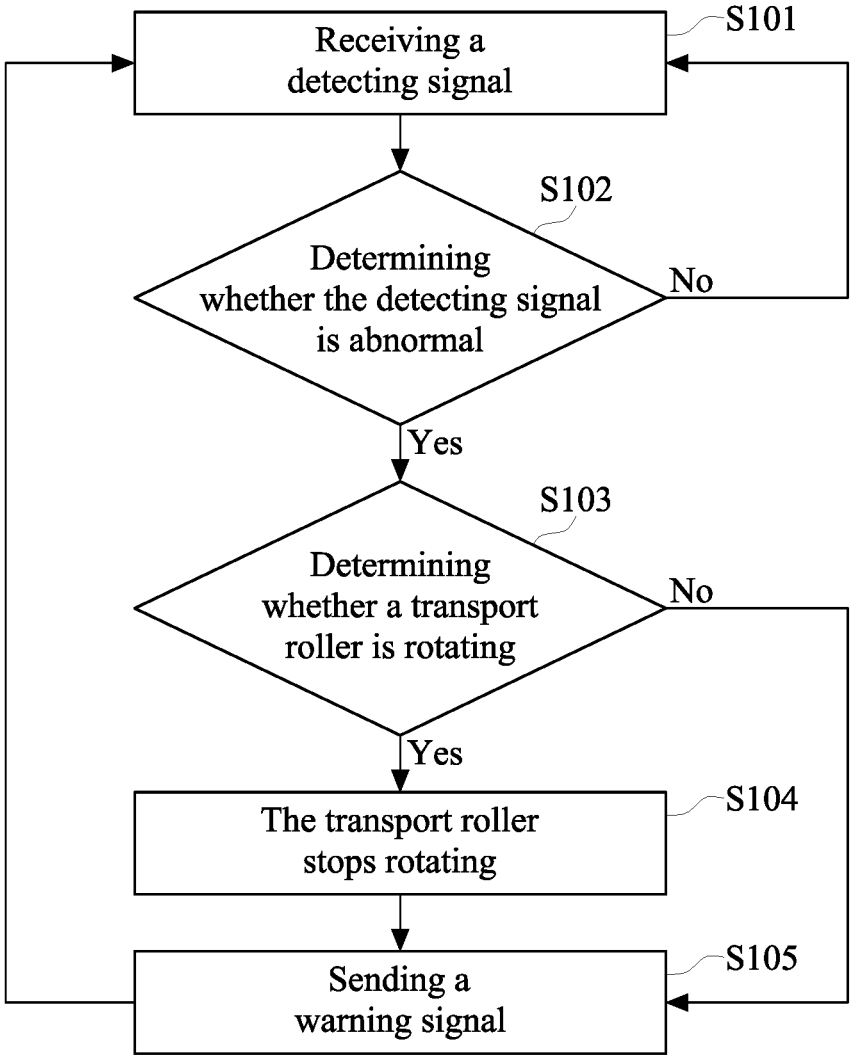
FIG. 7 is a flow chart of the transport mechanism for determining the transport status of the flexible object according to the first embodiment of the disclosure.

The following describes the determining process in the first embodiment of the present disclosure that the detector sends the detecting signal according to the relative location of the trigger component 150 and the detector 130, and then the processor 140 executes the transport status determining process according to the detecting signal send by the detector 130; please refer to FIG. 7. FIG. 7 is a flow chart of the transport mechanism for determining the transport status of the flexible object according to the first embodiment of the disclosure.

First, step S101 is receiving the detecting signal. The processor 140 receives a detecting signal from the detector 130. The detecting signal is the normal detecting signal or the abnormal detecting signal which are mentioned above. When the pressed portion 151 of the trigger component 150 is not pressed by the flexible object and located at its original position, the detector 130 is not triggered by the moving portion 152 of the trigger component 150 so that the detector 130 transmits the normal detecting signal to the processor 140. When the pressed portion 151 of the trigger component 150 is pressed by the flexible object deviated from the transport path, the pressed portion 151 drives the moving portion 152 to trigger the detector 130 so that the detector 130 transmits the abnormal detecting signal to the processor 140 timely. The transport status determining process executed by the processor 140 is to determine whether the aforementioned detecting signal is normal or abnormal.

Next, step S102 is determining whether the detecting signal is abnormal. If the result is no, which means the detecting signal is the normal detecting signal, go back to step S101 for receiving the detecting signal, and the processor 140 keeps receiving the detecting signal from the detector 130.

If the result is yes, which means the detecting signal is the abnormal detecting signal, go to step S103, which is determining whether a transport roller is rotating. If the result is no, which means the transport roller 120 is not rotating, go to step S105, which is sending a warning signal by the processor 140, and then go back to step S101 for receiving the detecting signal, and the processor 140 keeps receiving the detecting signal from the detector 130.

If the result is yes, which means the transport roller 120 is not rotating, go to step S104, which is that the transport roller 120 stops rotating. The processor 140 controls the power source 122 to stop the rotation of the transport roller 120 so that the transport roller 120 stops moving the flexible object into the gap between the tray 110 and the transport roller 120 continuously. Then go to step S105, which is sending a warning signal by the processor 140, and then go back to step S101 for receiving the detecting signal, and the processor 140 keeps receiving the detecting signal from the detector 130. A way for the processor 140 to stop the rotation of the transport roller 120 can be shut down the power source 122 or disconnect the transport roller 120 from the power source 122.

In the first embodiment of the present disclosure, if the detecting signal is the abnormal detecting signal, go to step S103, which is determining whether a transport roller is rotating, but the present disclosure is not limited thereby. In other embodiments of the present disclosure, if the detecting signal is the abnormal detecting signal, the next step can determine whether an operation is undergoing. The operation can be that a scan unit is scanning or a print head is printing. If the operation is undergoing, the processor shuts down the power source to stop the operation timely.

In the first embodiment of the present disclosure, the pressed portion 151 of the trigger component 150 is pressed by flexible object deviated from the transport path, the moving portion 152 and the pressed portion 151 of the trigger component 150 moves together to trigger the detector 130 to transmit the abnormal detecting signal timely. When the processor 140 receives the abnormal detecting signal, the processor 140 stops the rotation of the transport roller 120 timely so that the flexible object deviated from the transport path stops moving timely. As a result, the transport mechanism 100 determines the transportation status of the flexible object timely to prevent damaging the flexible object when paper jam happened, and the abrasion or the malfunction of the transport mechanism is prevented.

Figure 8:
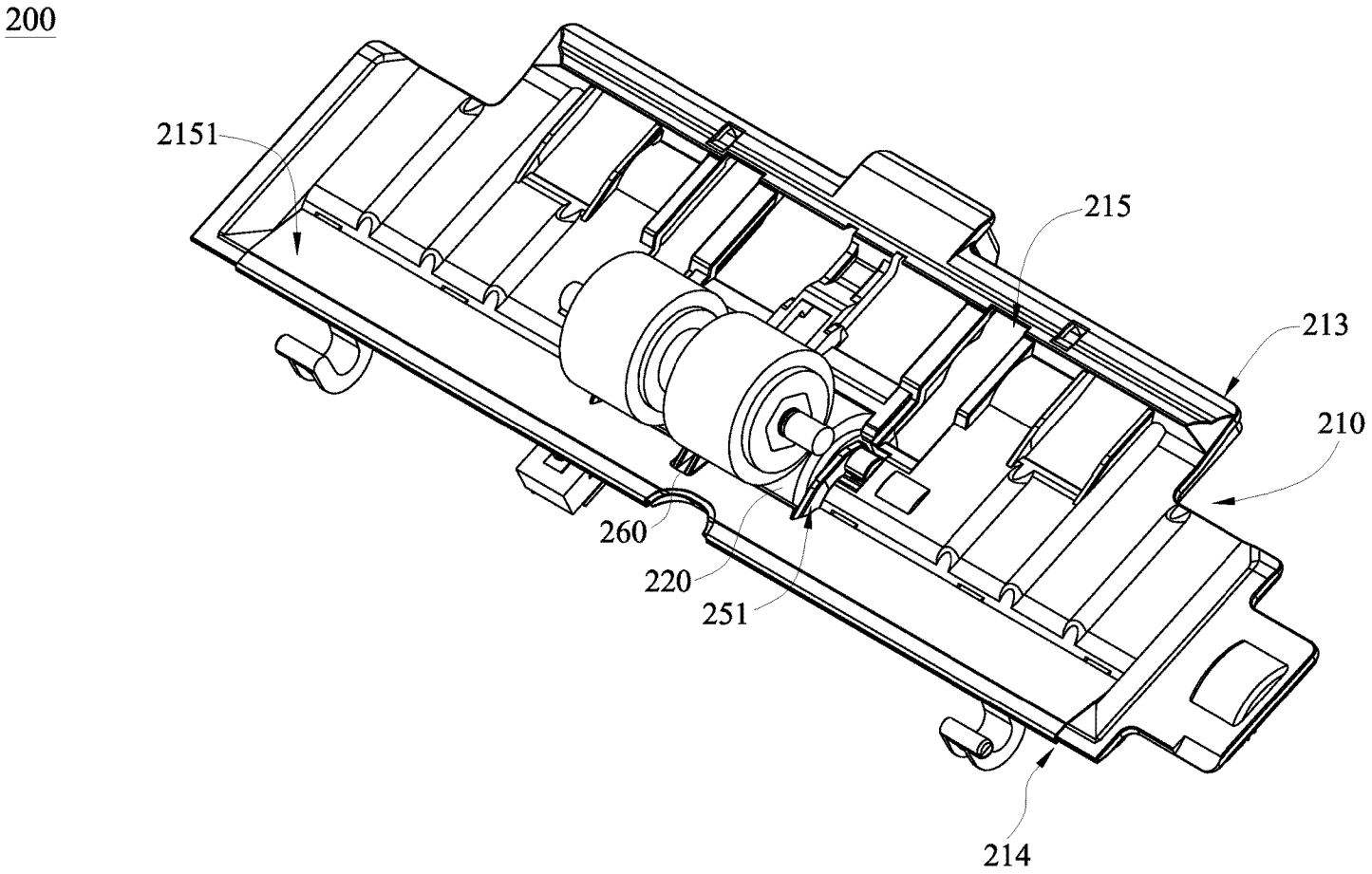
FIG. 8 is a perspective view of a transport mechanism from one viewing angle according to a second embodiment of the disclosure.
Figure 9:
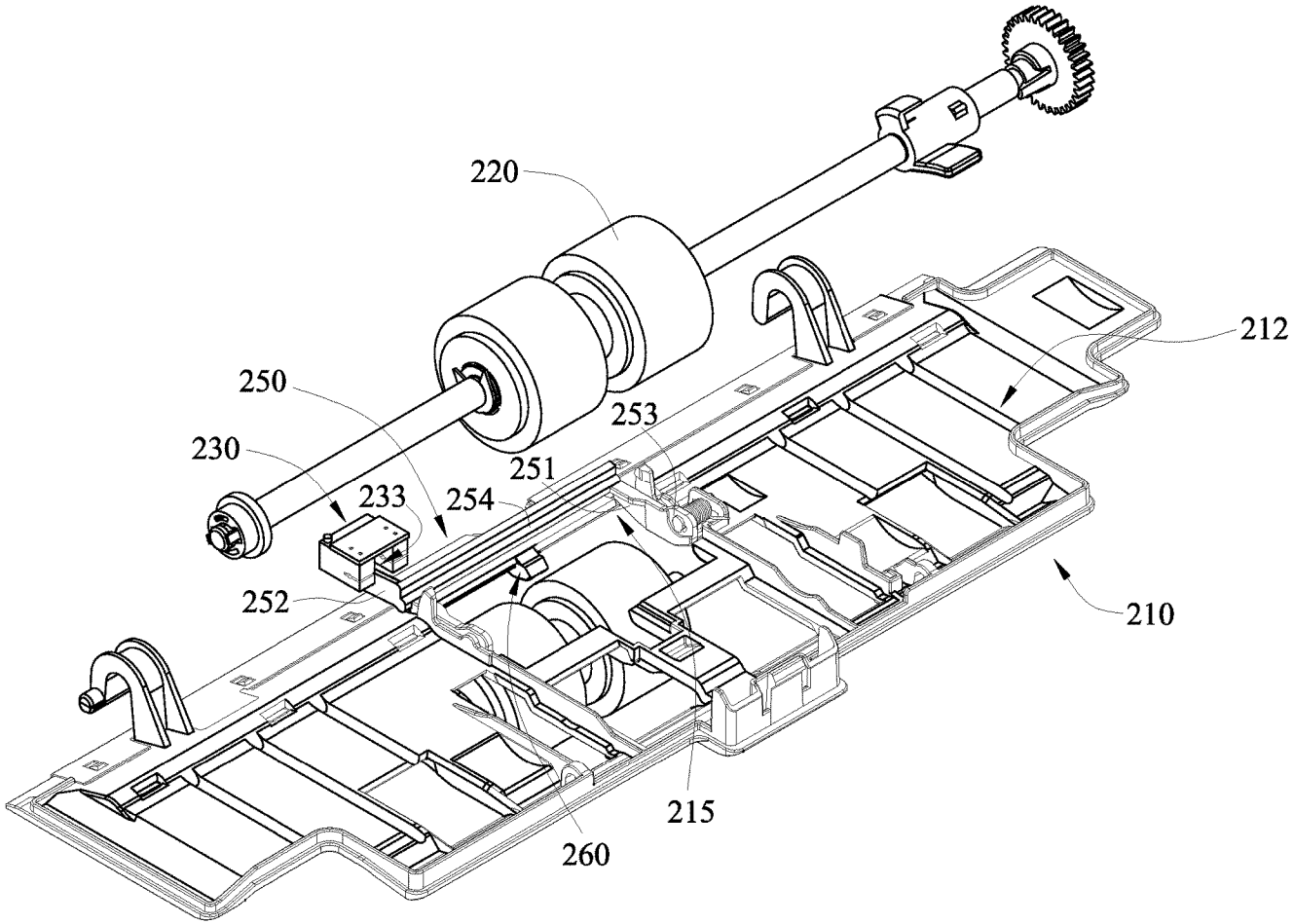
FIG. 9 is an exploded view of the transport mechanism from another viewing angle according to the second embodiment of the disclosure.
Figure 10:
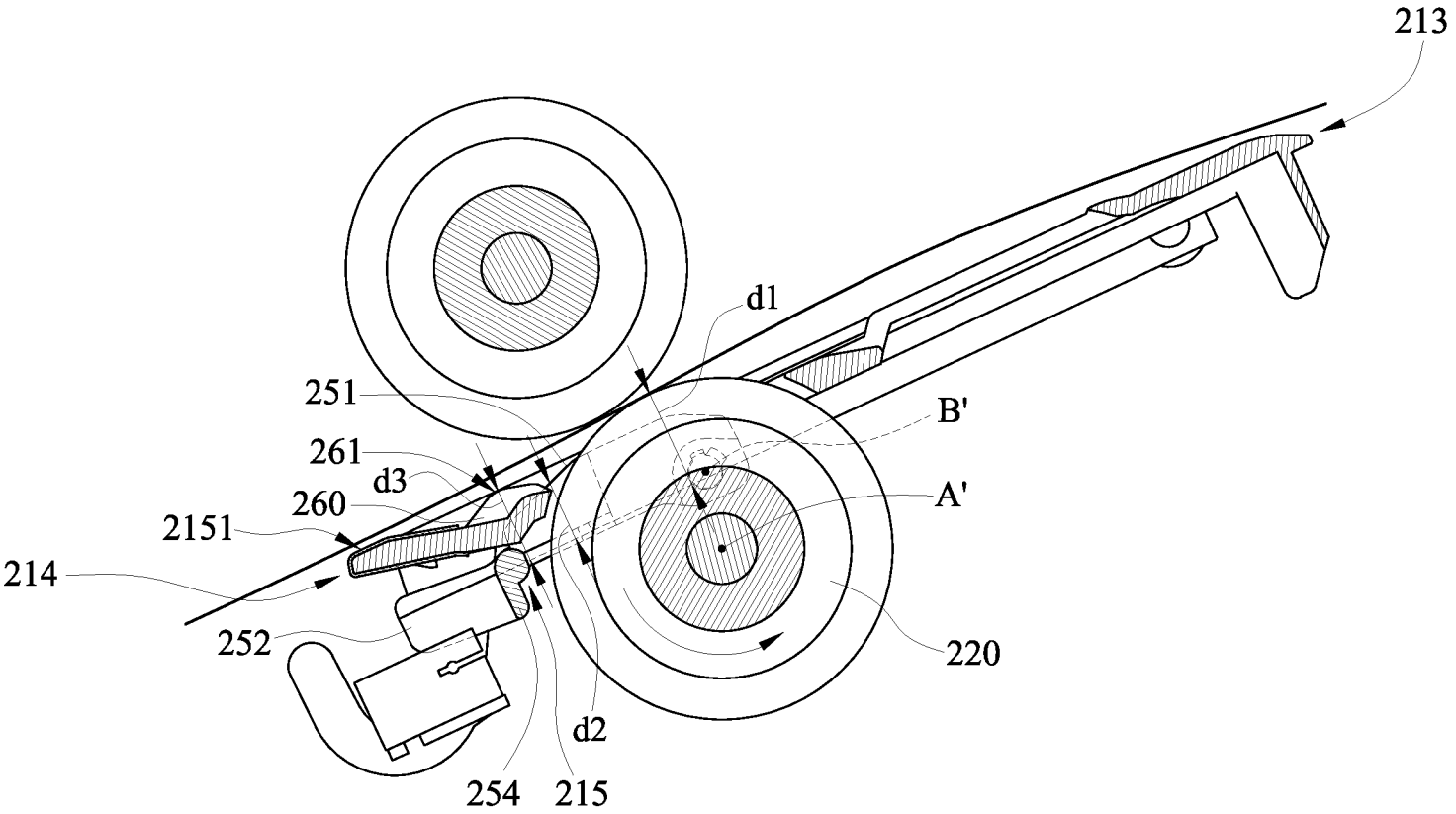
FIG. 10 is a cross-sectional view of the transport mechanism transporting a flexible object at a normal transport status according to the second embodiment of the disclosure.
Figure 11:
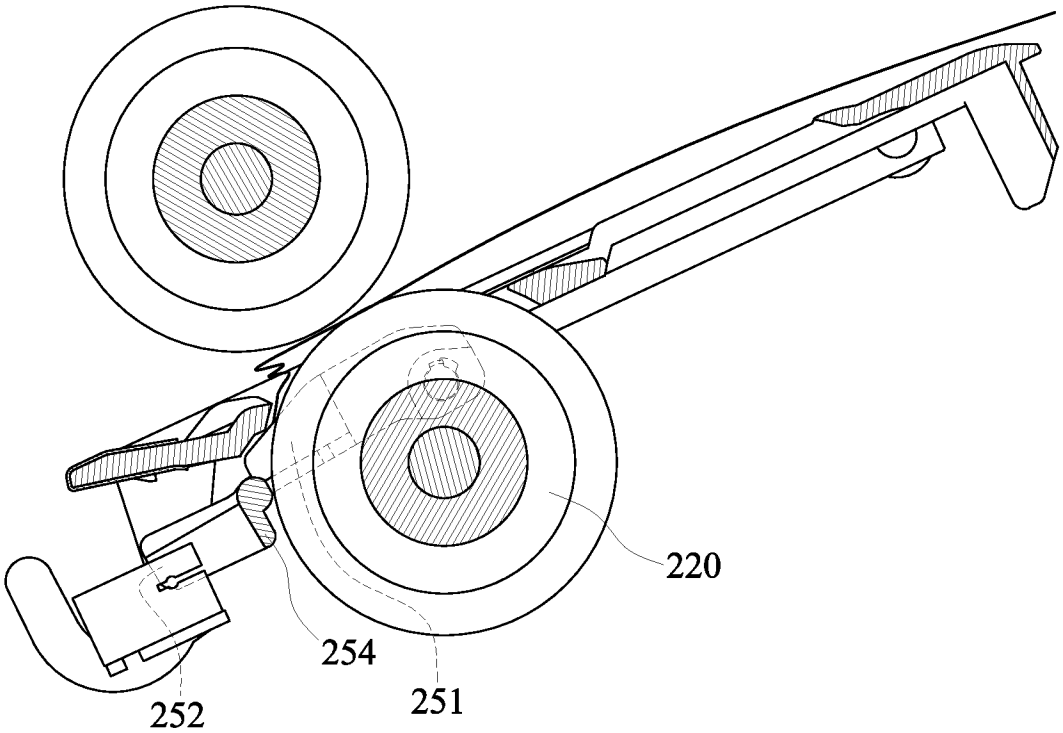
FIG. 11 is a cross-sectional view of the transport mechanism transporting the flexible object at an abnormal transport status according to the second embodiment of the disclosure.

The following describes a transport mechanism 200 in the second embodiment of the present disclosure. Please refer to FIG. 8 to FIG. 11. FIG. 8 is a schematic view of a transport mechanism from one viewing angle according to a second embodiment of the disclosure. FIG. 9 is a schematic view of the transport mechanism from another viewing angle according to the second embodiment of the disclosure. FIG. 10 is a cross-sectional view of the transport mechanism transporting a flexible object at a normal transport status according to the second embodiment of the disclosure. FIG. 11 is a cross-sectional view of the transport mechanism transporting the flexible object at an abnormal transport status according to the second embodiment of the disclosure. The transport mechanism 200 in the second embodiment is similar to the transport mechanism 100 in the first embodiment. Therefore, the following descriptions focus on the difference between the first embodiment and the second embodiment, and the similar features are not repeated hereafter.

In the second embodiment of the present disclosure, a tray 210 of the transport mechanism 200 includes an opening 215. Two transport rollers 220 are located in the opening 215, and the two transport rollers 220 are rotatable along a first rotating axis A' relative to the tray 210.

A trigger component 250 includes two pressed portions 251, a moving portion 252, two pivotal portions 253 and a connecting portion 254. The two pressed portions 251 are connected to the two pivotal portions 253, respectively. The moving portion 252 is connected to one of the two pressed portions 251, and the two pressed portions 251 are connected by the connecting portion 254 so that the two pressed portions 251 moves together. The two pressed portions 251 are located in the opening 215, and the two transport rollers 220 are located between the two pressed portions 251 so that the detecting effect of detecting the flexible object deviated from the transport path is improved. The moving portion 252, for example, is normally located out of a detecting area 233 of a detector 230. When one of the two pressed portions 251 is pressed by the flexible object and rotates along a second rotating axis B' relative to the tray 210, the moving portion 252 enters the detecting area 233 to trigger the detector 230.

The transport mechanism 200 further includes a guiding component 260. The guiding component 260 is protruded from the inclined surface 2151. A third distance d3 is between the top edge 261 of the guiding component 260 and the back surface 212 of the tray 210. The third distance d3 is larger than the second distance d2, and the third distance d3 is smaller than the first distance d1 so that the guiding component 260 is able to guide the edge of the flexible object to pass the two transport rollers 220. As a result, when the edge of the flexible object deviates from the transport path, the guiding component 260 helps to guide the edge of the flexible object back to the transport path so that the possibility that the flexible object moves toward the opening 215 and presses the pressed portion 251 of the trigger component 250 or even jams in a gap between the transport rollers 220 and the side surface of the opening 215 is reduced. In the second embodiment of the present disclosure, a connection between a location where the guiding component 260 is protruded from the inclined surface 2151 and a gap between the two transport rollers 220 is parallel to the moving direction of the flexible object from the input side 213 to the output side 214, but the present disclosure is not limited thereby. In other embodiment of the present disclosure, the connection between the location where the guiding component is protruded from the inclined surface and a gap between the two transport rollers intersects with the moving direction of the flexible object from the input side 213 to the output side.

According to the transport mechanism for the peripheral device and the operating method including the same of the present disclosure, when the flexible object is deviated from the transport path, the flexible object presses the pressed portion of the trigger component and triggers the detector timely by the moving portion of the trigger component. Then, the detector transmits a detecting signal to the processor timely for warning that the flexible object has deviated from the transport path so as to avoid the transport roller bringing the flexible object into the gap between the tray and the transport roller continuously. Therefore, damages on the flexible object and the abrasion or malfunction of the transport mechanism are prevented.

In addition, the guiding component near the opening guides the flexible object passing the transport roller to move toward the output side. Therefore, the chance that the flexible object moves toward the opening and presses the pressed portion of the trigger component or even jams in a gap between the transport rollers and the side surface of the opening is reduced.

What is claimed is:

1. A transport mechanism for a peripheral device, comprising:

a tray having a supporting surface, a back surface and at least one opening, the supporting surface and the back surface being opposite to each other, the at least one opening extending through the supporting surface and the back surface, and the supporting surface being for supporting a flexible object;

at least one transport roller rotatably installed in the at least one opening and protruded from the supporting surface, and the at least one transport roller being for transporting the flexible object to move along a transport path;

a detector near the back surface of the tray, and the detector having a detecting area;

a trigger component comprising at least one pressed portion and a moving portion which are connected with each other, a portion of the at least one pressed portion movably located in the at least one opening and spaced apart from the flexible object on the transport path, and the moving portion corresponding to a sensing area of the detector; when the flexible object deviated from the transport path, the at least one pressed portion is pressed by the flexible object so as to drive the moving portion to enter or leave the detecting area, and thereby triggering the detector to transmit an abnormal detecting signal; and a processor electrically connected to the detector and the at least one transport roller, and the processor configured to stop the transport roller when receiving the abnormal detecting signal, wherein the trigger component further comprises a pivotal portion, the pivotal portion connects the at least one pressed portion and the moving portion, the pivot portion is pivoted on the tray and close to the at least one transport roller.

2. The transport mechanism for the peripheral device according to claim 1, wherein a top edge of the at least one transport roller is protruded from the back surface of the tray by a first distance, a top edge of the at least one pressed portion is protruded from the back surface by a second distance, and the first distance is larger than the second distance.

3. The transport mechanism for the peripheral device according to claim 1, wherein the tray has an input side and an output side which are opposite to each other, the at least one opening is located between the input side and the output side, the at least one opening has an inclined surface close to the output side and connecting the supporting surface and the back surface, and the inclined surface faces away from the back surface.

4. The transport mechanism for the peripheral device according to claim 3, wherein a portion of the pressed portion is located above the inclined surface.

5. The transport mechanism for the peripheral device according to claim 1, wherein the at least one transport roller is rotatable relative to the tray along a first rotating axis, the trigger component is rotatable relative to the tray along a second rotating axis, and the second rotating axis is located between the first rotating axis and the supporting surface of the tray.

6. The transport mechanism for the peripheral device according to claim 5, wherein the detector comprises a signal-transmit portion and a signal-receive portion which are facing each other, the detecting area is located between the signal-transmit portion and the signal-receive portion, when the at least one pressed portion of the trigger component is pressed by the flexible object, the trigger component rotates the moving portion to enter or leave the detecting area so as to trigger the detector.

7. An operating method of a transport mechanism for a peripheral device, comprising:

rotating a transport roller to transport a flexible object;

transmitting a detecting signal by a detector according to a relative position between a trigger component and the detector, wherein when the trigger component is pressed by the flexible object, the detecting signal transmitted by the detector is abnormal, and when the trigger component is not pressed by the flexible object, the detecting signal transmitted by the detector is normal; and receiving the detecting signal by a processor and determining the detecting signal is abnormal or normal, wherein when the detecting signal is abnormal, the processor controls the transport roller to stop rotating, when the detecting signal is normal, the processor controls the transport roller to keep rotating, wherein the trigger component further comprises a pivotal portion, the pivotal portion connects the at least one pressed portion and the moving portion, the pivot portion is pivoted on the tray and close to the at least one transport roller.

* * * * *